US005172351A

United States Patent [19]

Corlet

[11] Patent Number: 5,172,351

[45] Date of Patent: Dec. 15, 1992

[54] PIECE MECHANISMS FOR WATCH MOVEMENTS

[75] Inventor: John Corlet, La Cote-Aux-Fees, Switzerland

[73] Assignee: Complications SA, La Cote-Aux-Fees, Switzerland

[21] Appl. No.: 827,418

[22] Filed: Jan. 29, 1992

[30] Foreign Application Priority Data

Feb. 5, 1991 [CH] Switzerland ..... 344/91

[51] Int. Cl.[5] ..... G04B 29/00

[52] U.S. Cl. ..... 368/319

[58] Field of Search ..... 368/88, 185, 187, 319-321

[56] References Cited

U.S. PATENT DOCUMENTS 3,762,153 10/1973 Komiyama et al. ..... 368/187
4,319,351 3/1982 Fujimori et al. ..... 368/187
4,408,896 10/1983 Ikegami ..... 368/185
4,423,964 1/1984 Griessen et al. ..... 368/74
4,447,163 5/1984 Tsukada et al. ..... 368/319
4,488,819 12/1984 Schaffner ..... 368/319
4,722,076 1/1988 Schnell ..... 368/319
4,818,830 4/1989 Bron ..... 200/341

FOREIGN PATENT DOCUMENTS 0240778 10/1987 European Pat. Off. .

*Primary Examiner*—Vit W. Miska
*Attorney, Agent, or Firm*—Young & Thompson

[57] ABSTRACT

The present invention relates to a mechanism for controlling the actuation of a member of a mechanical or electrical time piece or watch by a push piece. It consists in a planar spring 13, the two end 14, 15 of which cooperate the one with the other. One of these ends 14 of this spring is in contact with a stem of the push piece 7 sliding into the watch case 5 and the side 13 opposite to this end 14 rests against an abutment 5.

9 Claims, 1 Drawing Sheet

PIECE MECHANISMS FOR WATCH MOVEMENTS

The push pieces mechanisms for watch movements which are known are generally of two types, the ones more particularly used in mechanical watches which control mechanically a function, chronograph, time setting, rapid setting and so on, and the others which are used in electronic watches which actuate electrical contacts.

The first type of mechanism for the mechanical watches comprises, on top of the pusher and of its stem, at least a tilting member hinged on a plate or bridge one end of which is subjected to the action of a return spring whereas the other cooperates with the member having to be actuated. Very frequently, the tilting member itself is realized in at least two pieces hinged the one to the other.

The number of pieces of this mechanism is great, the shape of the tilting member is generally complicated, and the mounting of this mechanism necessitates a skilled worker and takes time since each part has to be mounted, assembled, set and the working of the whole has to be checked.

The mechanism of the second type comprise generally a pushing stem subjected to the action of a return spring located concentrically to said stem and actuating an electrical contact. This type of mechanism has two drawbacks, on the one hand, the tightness between the case of the watch and the pusher is difficult to realize due to the presence of the return spring and on the other hand, the fact that there is no snapping effect at the end of the stroke of the pusher indicating that the desired function has been executed.

One further knows from document EP-B1-0.240.778 a push piece mechanism comprising a flat spring presenting the general shape of a hair-spring, having two arms of different lengths, which is guided and positionned on the plate of the movement through several abutments or pins to be able to bend and permitting that one of its arms at least can slide with respect to the plate.

This spring comprises near the end of the short arm a rest member cooperating with another rest member carried by the middle portion of the long arm of the spring, the end of which actuates an electrical contact.

The drawbacks of such a mechanism are its encumbrance, the complex positioning of the spring onto the plate, the linear sliding movement of one part at least of the spring during the working and the imprecision of the working and particularly of the time where the snapping effect is obtained by said mechanism.

The present invention has for its object a push piece mechanism for a mechanical or electronic watch movements tending to obviate the precited drawbacks of the existing mechanisms permitting an easy positioning of the spring, having a small encumbrance, a great security and a great precision in its working as well as an easy mounting which do not necessitate any precision nor skilled worker.

This push piece mechanism for watch movements intended to actuate a control member, which can be mechanical or electrical, by means of a push piece is characterized by the fact that it consists in a planar spring the two ends of which cooperate the one with the other; by the fact that one of the ends of the spring is in contact with a push piece stem sliding into the watch case and that the side opposite this end rests against an abutment.

The attached drawing shows schematically and by way of example one particular embodiment of the push piece mechanism according to the invention.

BRIEF DESCRIPTION OF THE DRAWING

FIG. 1 shows a time piece, for example a chronograph, comprising a case 1 provided with two pushers 2, 3 which can actuate electrical contacts in the case of an electronic watch with quartz movement or which can cause mechanically the actuation of a control member of a given function in a mechanical watch movement.

Figure 1:
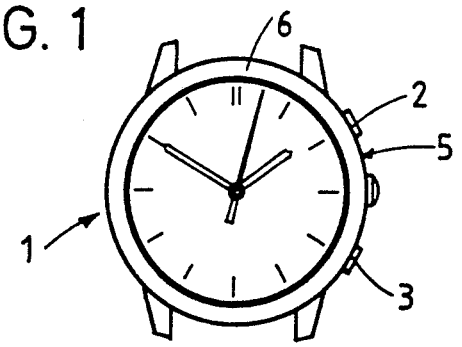
FIG. 1 shows a time piece provided with two pushers.

The mechanism shown is mounted in a housing 4 provided in the middle part 5 of the watch case 1 and opening on its peripheral surface as well as on the upper face 5*a* which is in contact with the lower face of the bezel 6.

This mechanism comprises a pusher or push piece stem 7 mounted on the middle part 5 extending radially and in a sliding manner. In the example shown this assembly is obtained by means of pins 8, 9 fastenend in the middle part and passing through slots 10, 11 of the stem of the push piece 7. A stop 12 formed by a finger fastenend in the middle part is also extending into the slot 10 to determine the rest position or retracted position of this push piece stem 7.

In a variant the push piece can comprise a cylindrical stem of conventional fashion sliding into an element of the watch case. In this case, the stop determining the rest position of the push piece can be carried by the watch case in a known manner.

It is evident that any sealing or tightning device known can be used to seal between the middle part 5, the bezel 6 and the push piece stem 7.

This mechanism comprises further a spring 13 also housed in the housing 4 of the midlle part 5 which rests against the bottom and a wall of this housing as well as against the end of the push piece stem 7. This spring 13 is uniplanar and seen from above presents a shape which is closed on itself, one of its ends 14, in contact with the push piece stem 7, presenting a rounded peak or beak 19 cooperating with the edge of its other end 15.

The edge of this end 15 of the spring constitutes a cam presenting two end stroke abutments 16, 17 and two recesses 18, 19*a* separated by a lift 20.

In the example shown the spring 13 rests against the bottom of the housing 4 of the middle part 5 at two points 21, 22. It is furthermore positionned by a central cylindrical abutment 23 fastened with the middle part intended to cooperate with certain portions 24, 25 of the internal edge of the spring 13 located between the rest points 21, 22 respectively between the rest point 22 and the end 14 of the spring.

The assembly of this mechanism is extremely simple, the push piece stem 7 is slid onto the pins 8, 9 and the stop 12, then the spring 13 is placed around the cylindrical abutment 23, its end 14 in contact with the end of the push piece stem 7. Finally the bezel is fixed onto the middle part. This assembly do not necessitate any fixing nor any adjustment and comprises only the setting in place of two parts.

In a variant of the described mechanism, the spring 13 and the cylindrical abutment 23 can be placed in a housing which would be provided in the watch movement itself, that means a bridge or the plate of the movement or in the casing ring. The push piece 7 always remains mounted in the watch case, the middle part of the watch case or the bezel. Thus, in such a variant, the essential elements of the mechanism, push piece 7 and spring 13 are identical to those described before and cooperate in the same manner but are mounted on different elements of the watch.

Figure 2:
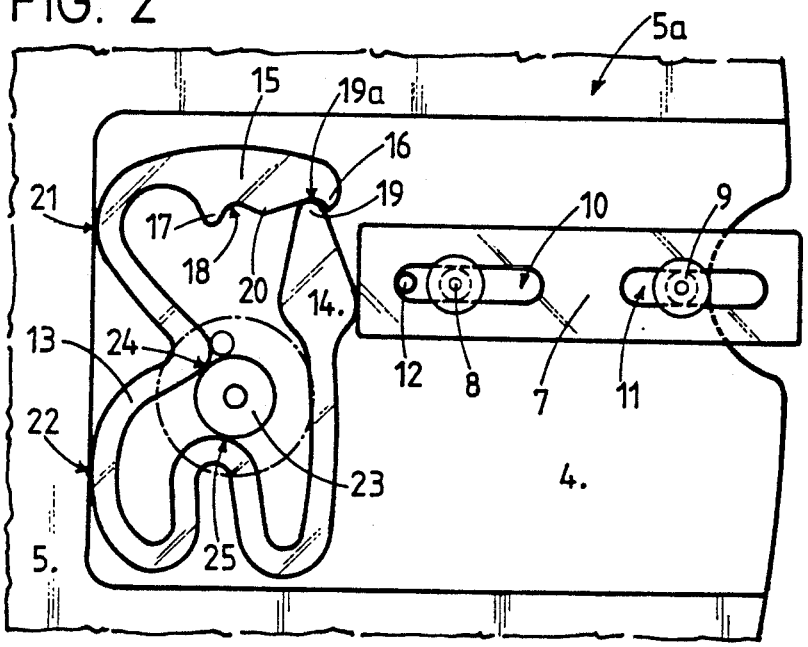
FIGS. 2 and 3 are top views, on a greater scale of the push piece mechanism in rest, retracted, position respectively in activated, pushed in, position.

The working of the described mechanism is the following:

In rest position, shown in FIG. 2, the stem of the push piece is maintained through the action of the spring 13 in position against the stop 12 and the beak 19 of the end 14 of the spring 13 is located in the recess 19*a*, in the vicinity of the end stroke abutment 16 of the end 15 of said spring.

Figure 3:
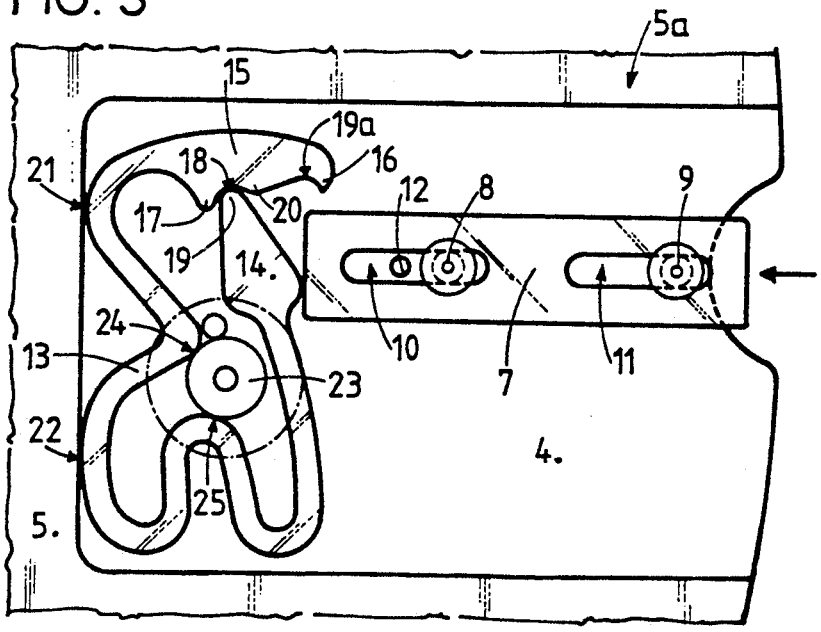

When the user pushes the push piece stem 7, it causes a displacement of the end 14 of the spring, the beak 19 of which cooperates with the lift 20, displaces resiliently the end 15 of the spring and this necessitates an increasing pushing force of predetermined value. Then this beak 19 passes over the summit of the lift 20 and the end 15 of the spring 13 come back under the effect of its resiliency while remaining in contact with the beak 19 but the pushing force diminishes suddenly to a negligible value. Then, finally the beak 19 enters in contact with the abutment 17 avoiding any subsequent displacement of the stem of the push stem 7 (FIG. 3).

This working simulates very exactly the action of a mechanical traditional push member and presents a snapping action indicating to the user that the function is well executed.

In the present case, the end 14 of the spring carries one of the contacts of a switch (not shown) the other one of which is fastened on a bridge or a plate of the watch movement. During the stroke of the end 14 of the spring the switch is closed and controls the desired function.

In a mechanical watch movement the end 14 or 15 of the spring can control a mechanical function.

When the user releases the pressure on the stem of the push piece 7, the resilient energy stored in the spring 13 causes the return of the end 14 of the spring to its position shown in FIG. 2. It is necessary that the force stored in the spring under the action of the push piece 7 be sufficient for the beak 19 to pass over the lift 20 by displacing the end 15 of the spring 13.

Advantageously the cross section of the spring 14 is rectangular, it could in a variant be square, circular or of any other shape. As well the shape in top view of the spring 13 can vary, the important fact is that both its free ends cooperate the one with the other to obtain the desired aim. The spring 13 could be maintained in position by means other than the central abutment 23, for example by means of several stops or other members. The important feature is that the spring 13 can be set in place by a simple laying or placing into the housing without any adjustment or fixing operation.

The shapes of the housing 4 and of the stem of the push piece 7 can be modified at will without influence on the conception or design and on the working of the mechanism.

The spring 13 is preferably inscribed within a rectangle and at rest state (FIG. 2) the two sides carrying the free ends of the spring touch this rectangle at one point whereas the two other sides touch it at two points. The shape and the exact dimensions of the spring 13 depend particularly on the working force which it is intended to obtain for the push piece which has to be as similar as possible as that of an existing mechanical pushers.

The material of which the spring is made is spring steel for example of the "Durmico" type which is currently used in this field. The dimensions of the rectangle circumscribed about the spring 13 are of the order of 3.5 mm by 2.5 mm, its thickness and its average width of the order of a few tenths of milimeter. Despite of the very small dimensions of this spring, its reliability is very high and it can last for several tens of thousands of workings at least.

It is evident that one can in an embodiment omit the central stop 23 fastened to the middle part 5*a*, the positioning of the spring being only realized by the shape of the housing 4 and the resting of its end 14 against the stem of the push piece 7.

Therefore in this embodiment the push piece mechanism or the mechanism actuated by the push piece is constituted by only one part, the spring. In any case, whatever the embodiment of this mechanism is, it comprises always only one movable part, the spring 13.

This mechanism is extremely compact. Fixing of the spring is easy and does not necessitate any precise positioning. In fact the spring is simply laid into the housing and maintained by the central abutment. The working stroke is precisely delimited by the spring itself, that is by the entry into contact of the beak 19 with the end stroke abutments 16, 17. There is no dead stroke the ends 14 and 15 of the spring being in permanent contact. As there is no sliding but only a very small displacement of the beak 14 with respect to the end 15, friction is limited to the minimum so as to reduce wear as well as the actuating force.

This mechanism is very simple, cheap, easy to assemble rapidly, very secure and necessitates no adjustement or setting. It can further be mounted on the watch case, on the bezel or on the watch movement, which renders its use very easy for the designer of a watch movement.

I claim:

1. In a time piece having a case having a push piece having a stem sliding in said case; the improvement comprising a uniplanar spring of elongated shape having two ends that remain continuously in contact with each other, one said end bearing against said push piece stem and a side of said spring opposite to said one end resting against an abutment on said time piece.

2. Structure as claimed in claim 1, wherein said one end terminates in a beak that slides against the surface on the other said end of the spring, said surface having two end abutments and a lift spaced between said abutments thereby to define two predetermined positions of said beak relative to said surface.

3. Structure as claimed in claim 2, said end bearing resiliently on said stem and having a rest position in which said end is against a said abutment at the end of said other end of the spring and in which said stem is extended from said case.

4. Structure as claimed in claim 1, in which said opposite side rests against said abutment at two spaced points.

5. Structure as claimed in claim 1, in which said spring has a side adjacent said one end that has a central inwardly extending U-shaped portion.

6. Structure as claimed in claim 1, the time piece having a central abutment that extends into a central opening of the spring and contacts the spring at at least one point.

7. Structure as claimed in claim 6, said spring contacting said abutment at two spaced points.

8. Structure as claimed in claim 7, wherein said spring has two U-shaped inwardly extending portions each contacting said abutment in one said point.

9. Structure as claimed in claim 8, wherein said opposite side of said spring contacts said abutment at two spaced points disposed on opposite sides of one of said U-shaped portions.

* * * * *